US006695049B2

(12) United States Patent
Ostocke et al.

(10) Patent No.: US 6,695,049 B2
(45) Date of Patent: Feb. 24, 2004

(54) VALVE ASSEMBLY FOR HYDROCARBON WELLS

(75) Inventors: Hugh D. Ostocke, Dunfermline (GB); Gordon G. Shiach, Dunfermline (GB); John Quinn, Motherwell (GB)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/900,930

(22) Filed: Jul. 9, 2001

(65) Prior Publication Data

US 2002/0017384 A1 Feb. 14, 2002

(30) Foreign Application Priority Data

Jul. 11, 2000 (GB) ..... 0017045

(51) Int. Cl.[7] ..... E21B 34/00; E21B 34/02

(52) U.S. Cl. ..... 166/97.1; 166/322; 166/332.5; 166/386

(58) Field of Search ..... 166/373, 374, 166/386, 332.5, 86.2, 87.1, 97.1, 86.3, 86.1, 319, 320, 322, 325, 332.8; 251/14, 58, 218, 222, 226, 227, 291, 324, 325, 337

(56) References Cited

U.S. PATENT DOCUMENTS 3,072,142 A * 1/1963 Yancey ..... 137/512.1
3,095,929 A * 7/1963 McGuire et al. ..... 166/88.4
3,830,306 A * 8/1974 Brown ..... 166/334.2
4,289,294 A * 9/1981 McLean ..... 138/89
4,415,036 A * 11/1983 Carmody et al. ..... 137/630.14
4,449,583 A 5/1984 Lawson
4,476,935 A * 10/1984 Hynes et al. ..... 137/68.14
4,478,286 A * 10/1984 Fineberg ..... 166/324
4,572,298 A * 2/1986 Weston ..... 137/625.48
4,662,603 A * 5/1987 Etheridge ..... 137/488
4,836,243 A * 6/1989 Ferrell ..... 137/556
4,907,650 A * 3/1990 Heinonen ..... 166/80.1
5,687,794 A * 11/1997 Watkins et al. ..... 166/363
6,095,250 A * 8/2000 Day et al. ..... 166/321
6,145,594 A * 11/2000 Jones ..... 166/361
6,186,239 B1 * 2/2001 Monjure et al. ..... 166/242.2
6,296,061 B1 * 10/2001 Leismer ..... 166/324

FOREIGN PATENT DOCUMENTS

GB 2 049 765 A 12/1980

* cited by examiner

*Primary Examiner*—David Bagnell
*Assistant Examiner*—Jennifer H Gay
(74) *Attorney, Agent, or Firm*—Henry C. Query, Jr.

(57) ABSTRACT

A valve assembly for hydrocarbon wells comprises a first valve (e.g., a conventional gate valve) and a second valve (e.g., a hydraulically operated, fail safe check valve). The second valve provides an alternative to the pressure barrier conventionally formed by a downhole annulus safety valve. It is installable/retrievable through the first valve using a tool of the type used for installation of surface wellhead VR (valve replacement) plugs.

13 Claims, 5 Drawing Sheets

VALVE ASSEMBLY FOR HYDROCARBON WELLS

BACKGROUND OF THE INVENTION

This invention concerns a valve assembly that may be used, for example, to vent fluid from or inject gas into a well annulus.

Annulus valves are used for injecting pressurized gas into well annuli, such as during petroleum production using gas lift. They are also used to bleed fluid from well annuli, to prevent pressure buildups that would otherwise damage the casing program. Conventionally, such annulus valves are situated in a conduit extending through the side wall of a wellhead.

Regulatory authorities generally require that at least two independent pressure barriers be provided in series between the pressurized volume within the well and the well exterior. In the case of annulus valves, an annulus safety valve positioned downhole in the annulus is often used to provide the necessary primary pressure barrier. Replacement or servicing of the annulus safety valve is a lengthy and expensive operation, as it will require removal of the tubing and tubing hanger.

SUMMARY OF THE INVENTION

The present invention aims to mitigate the foregoing problem and accordingly provides a well valve assembly comprising a passage extending through a side wall of a wellhead; and first and second valves each positioned to selectively open or close the passage, the second valve in use being located in the passage, towards the well interior with respect to the first valve, and being installable and retrievable through the passage. The second valve can therefore be removed for repair or renewal without disturbing other wellhead components such as the tubing hanger and tubing. Relatively compact, lightweight and unsophisticated pressure containment equipment, such as a lubricator of the kind normally used to install VR (valve removal) plugs in surface wellheads, can be used to maintain pressure integrity of the well and manipulate the second valve into its installed position in the passage.

Preferably, the second valve is installable and retrievable through the first valve, so that no need exists to disturb the first valve and the first valve can therefore remain available to close the passage.

The second valve is preferably remotely, for example hydraulically, actuated. It may be biased towards the closed position, to provide fail safe closure of the passage. The closure bias may be provided by one or more Belleville springs and/or fluid pressure. The Belleville springs may be housed in a chamber isolated from the passage and from the well exterior, to avoid problems of contamination, erosion and corrosion.

The second valve may take the form of a check valve which is closeable by engagement of a closure member with a valve seat to form a metal to metal seal. The closure member is preferably slidable in a tubular valve body which is received in the passage. A hydraulic chamber may be defined between the closure member and the body for actuation of the valve. The closure member may be held in the body by a retainer cartridge, a further hydraulic chamber being defined between the closure member, the body and the cartridge.

The valve seat may be formed annularly about the body interior, and the closure member may be hollow so as to comprise an open end and a blind end, a shoulder being formed about the blind end for co-operation with the valve seat, and radial ports extending from an exterior surface of the closure member behind the shoulder to the hollow interior of the closure member.

BRIEF DESCRIPTION OF THE DRAWINGS

Further preferred features of the invention are in the following description of an illustrative embodiment, made with reference to the drawings, in which.

DETAILED DESCRIPTION OF THE PREFERRED EMBODIMENTS

Figure 1A:
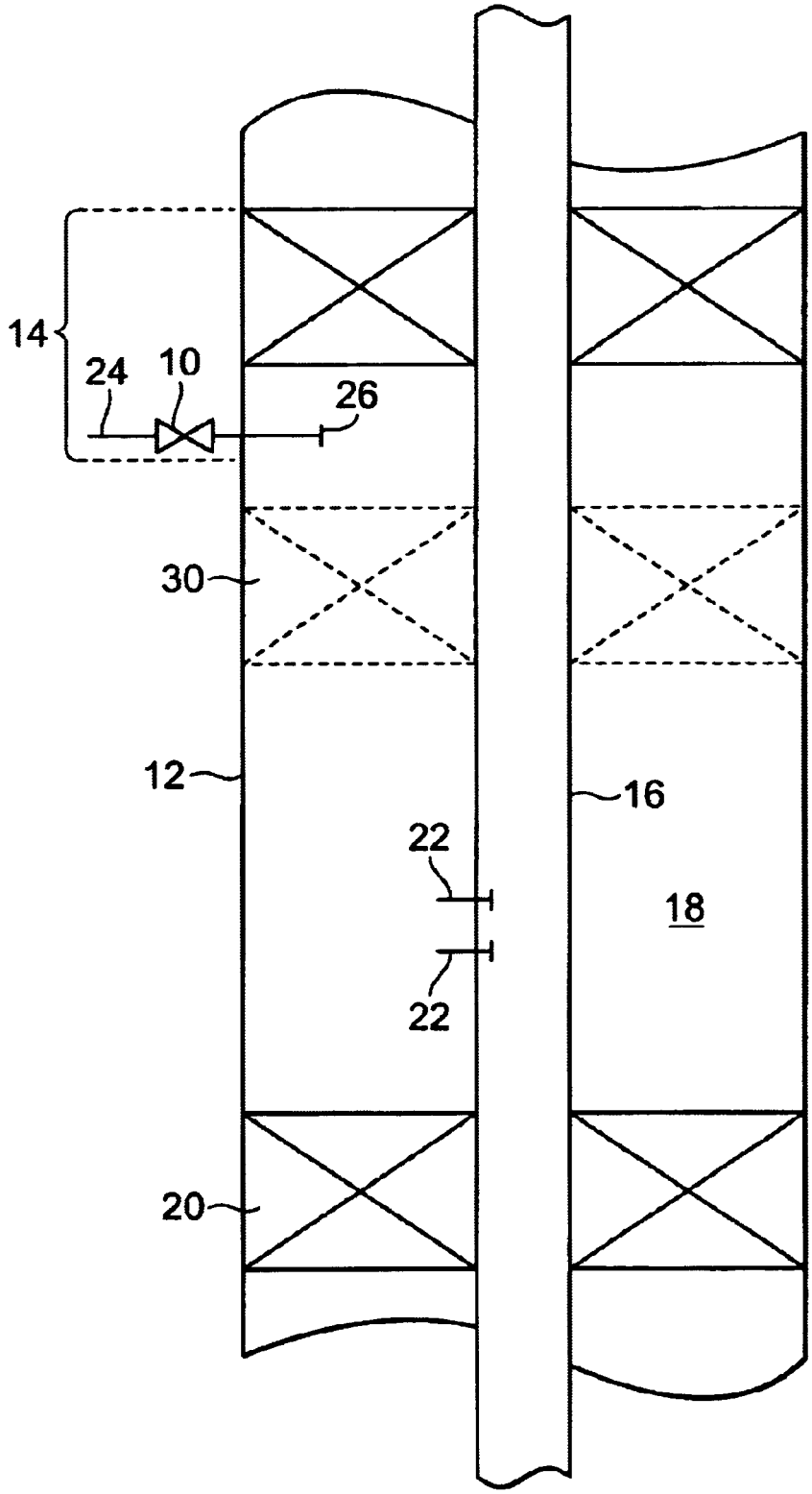
FIG. 1A is a schematic layout of part of a well, showing the first and second valves used for gas injection.

The hydraulically operated wellhead annulus check valve forming the second valve in the preferred embodiments is an alternative means of providing a barrier typically supplied by use of a downhole annular safety valve, thus eliminating the expensive and time consuming process of annular safety valve replacement in the event of failure. FIG. 1A shows the first valve 10 mounted to the wellhead, which together with the tubing hanger and packoff is schematically illustrated at 14. The first valve 10 may be, for example, a three inch (76.2 mm) gate valve of conventional form. The tubing hanger supports tubing 16 which defines a wellhead annulus 18 between the production casing 12 and the tubing. A downhole packer 20 seals the lower end of the annulus 18. The tubing is provided with gas lift valves 22. A two inch (50.8 mm) gas supply line 24 is connected to the first valve 10 for supplying pressurized gas to the annulus 18 and thence to the gas lift valves 22. The second valve 26 is connected in series with the first valve 10 inside the wellhead wall (not shown).

Figure 1B:
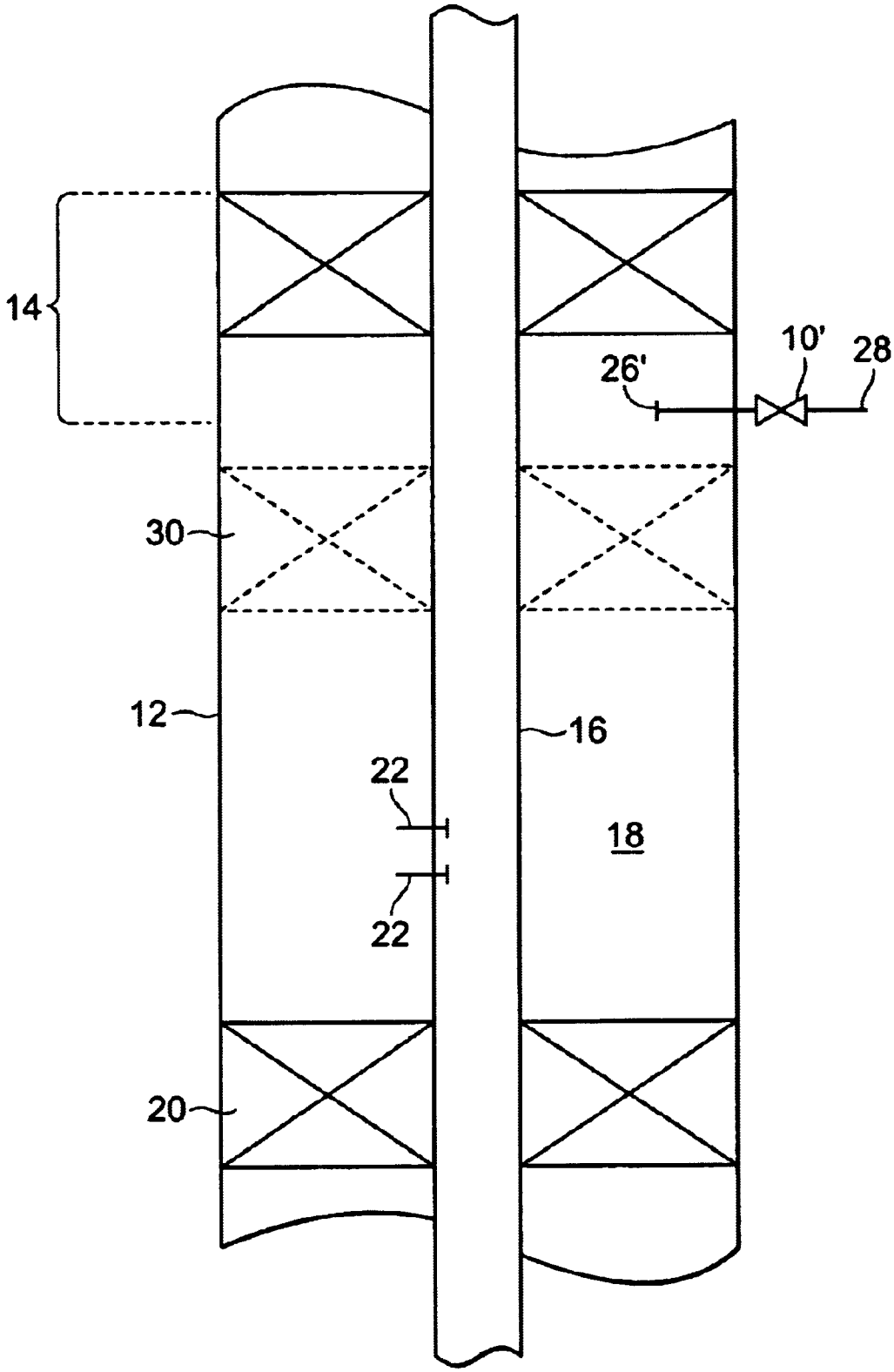
FIG. 1B is a schematic layout of the part of the well of FIG. 1A, showing alternative first and second valves used for pressure bleed down.

FIG. 1B illustrates an alternative embodiment of the invention which may be used to bleed off annulus pressure. In this embodiment the second valve 26' is again connected to the first valve 10', for example a four inch (101.6 mm) gate valve, which is mounted to the wellhead 14. The first valve 10' is in turn connected to a bleed nipple 28, instead of the gas supply line 24. In either embodiment, the second valve 26, 26' replaces and eliminates the downhole annulus safety valve 30 indicated in chain dotted lines.

Figure 2:
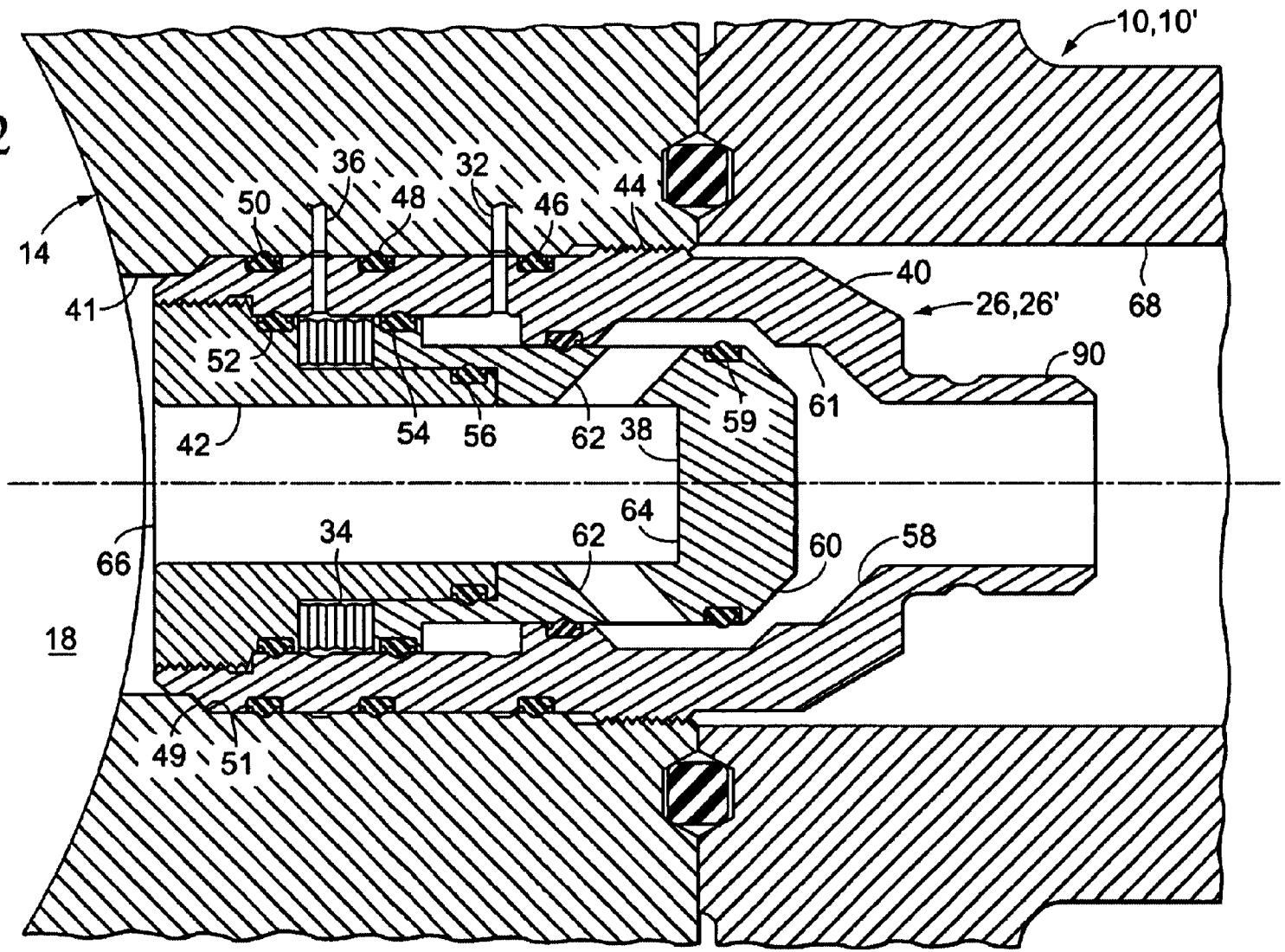
FIG. 2 is a detailed cross-section of the second valve, shown in the open position.

The second valve 26, 26' is hydraulically operated, i.e., hydraulic pressure is used to keep it in the open position shown in FIG. 2, allowing flow to pass freely through the valve. This actuation pressure is provided via a port 32 in the wellhead 14. When actuation pressure is vented or inadvertently lost, Belleville springs 34 return the second valve 26, 26' to its closed position (see FIG. 3), preventing flow through the valve. Thus, the second valve 26, 26' is a "fail-close" device.

A second port 36 is provided as a vent, to ensure full stroking of the valve 26, 26'. This second port may also be used as a means of stroking and holding the valve closed.

The second valve 26, 26' comprises a closure member in the form of a piston 38 and a tubular valve body 40 in which the piston slides. The body 40 is held in the passage 41 formed in the wellhead 14 side wall, by screw threads 44. The body 40 is circumferentially sealed to the wall of the passage 41 by annular elastomeric seals 46, 48, 50. These act as a backup to a metal-to-metal seal formed between corresponding tapered shoulders 49 and 51 on the body 40 and passage 41 respectively.

The piston is held in the valve body 40 by a retainer cartridge 42. An annular region of the piston 38 on which the Belleville springs 34 sit is isolated from the passage 41 by annular seals 52, 54, 56. This is to negate the effect of pressure end load on the piston annulus during normal operation, and also protects the Belleville springs from flow through the check valve. The body 40 includes an annular valve seat 58 that co-operates with a shoulder 60 on the piston 38 to form a metal-to-metal seal when the valve 26, 26' is closed. An elastomer backup seal 59 is provided on the piston 38, co-operating with a cylindrical seal surface 61 in the body 40. Radial ports 62 extend from behind the seal 59 and shoulder 60, to a hollow interior of the piston 38 and retainer cartridge 42, having an outwardly directed blind end 64, and an open end 66 communicating with the annulus 18. This provides a flow path through the check valve 26 when the piston shoulder 60 is moved away from the valve seat 58 and the backup seal 59 is moved away from the seal surface 61.

Figure 3:
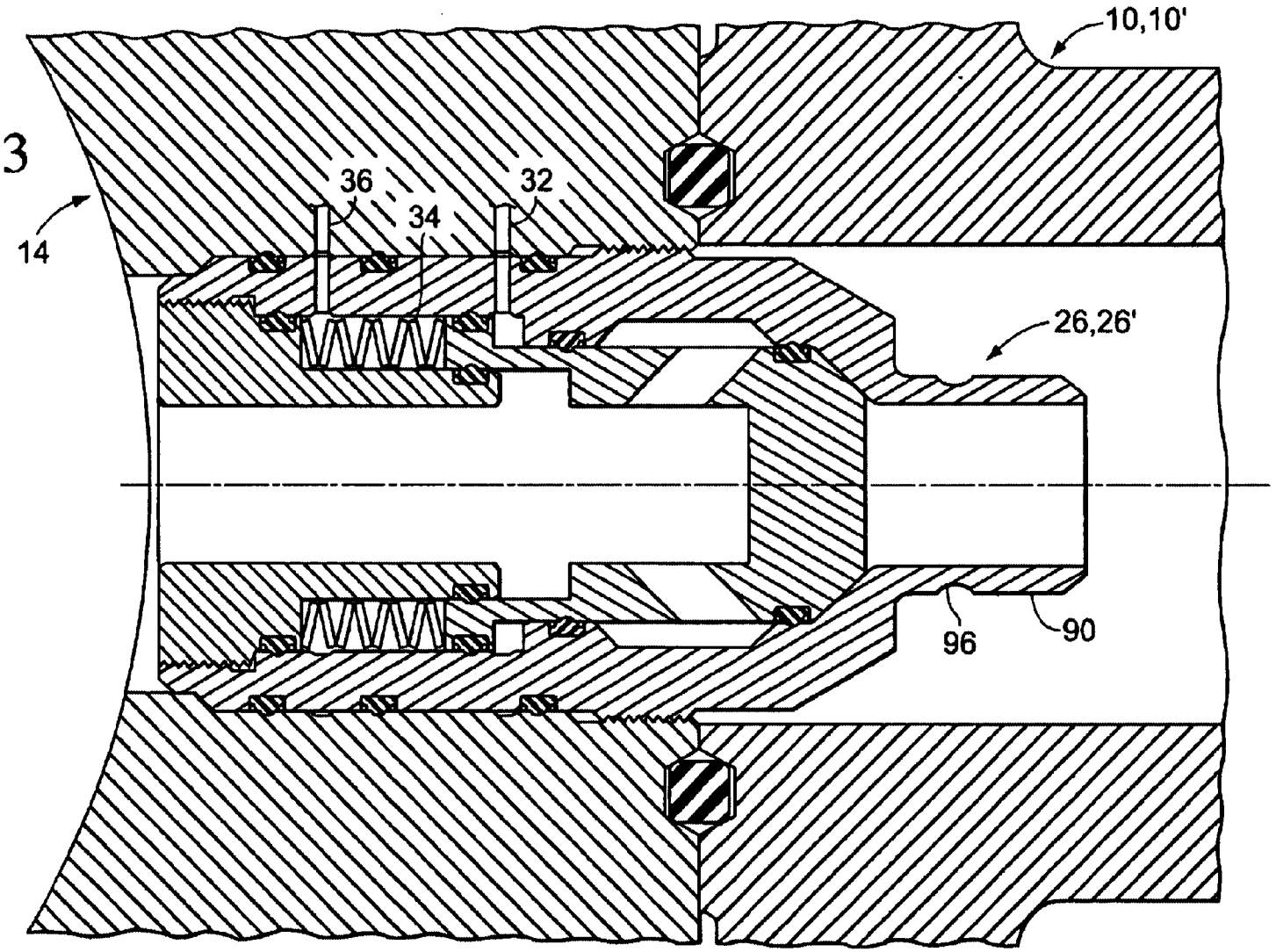
FIG. 3 corresponds to FIG. 2, but shows the second valve in the closed position.

The preferred second valve 26, 26' is installed and removed in the same manner as currently used for installation and removal of surface wellhead VR plugs, i.e., using a VR lubricator type tool which strokes through the first valve 10, 10'. For this purpose, the bore 68 of the first valve 10, 10' is made sufficiently large to drift the second valve 26, 26', as shown in FIGS. 2–4.

Figure 4:
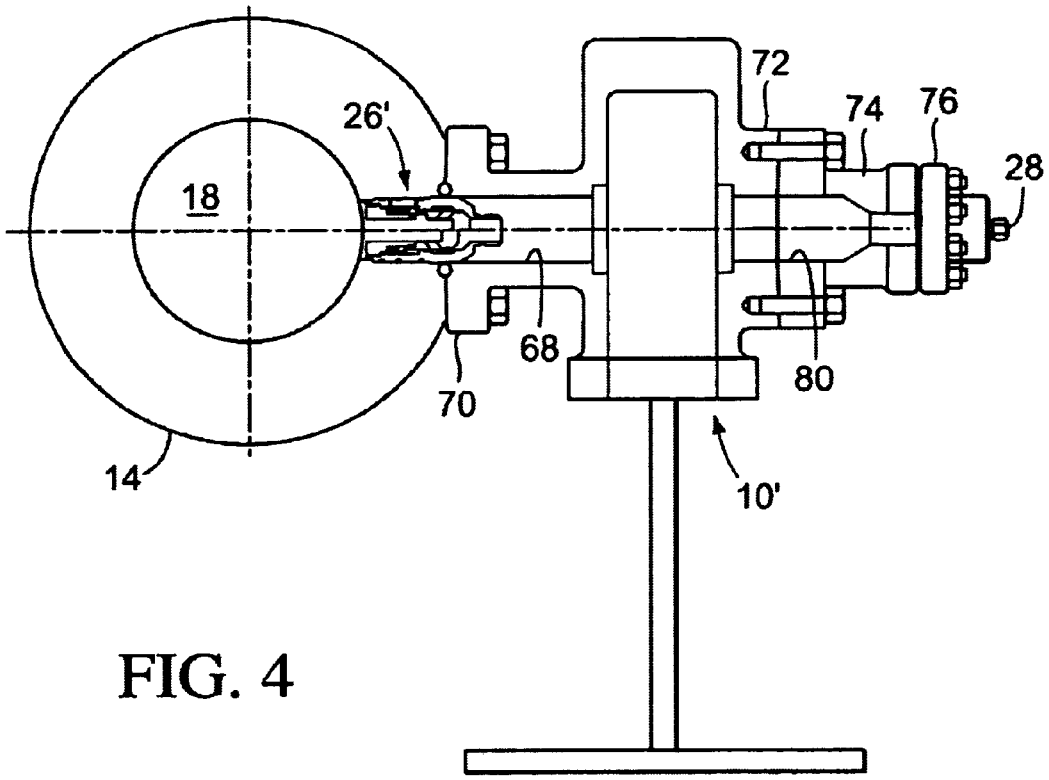
FIG. 4 is a cross-section through a wellhead, showing the first and second valves.

Referring to FIG. 4, a connector flange 70 of the first valve 10' is bolted to the wellhead 14. An opposite connector flange 72 of the valve 10' is bolted to an adapter 74. A blanking plate 76 containing the bleed nipple 28 is bolted to the distal end of the adapter 74. The arrangement for the gas injection valve assembly 10, 26 is similar, except that the blanking plate 76 is replaced by an end flange connection of the gas supply pipe 24. The adapter 74 defines a cavity 80 of sufficient size to contain the second valve 26', with the gate of the first valve 10' closed, during the installation/retrieval process, as further described below.

Figure 5:
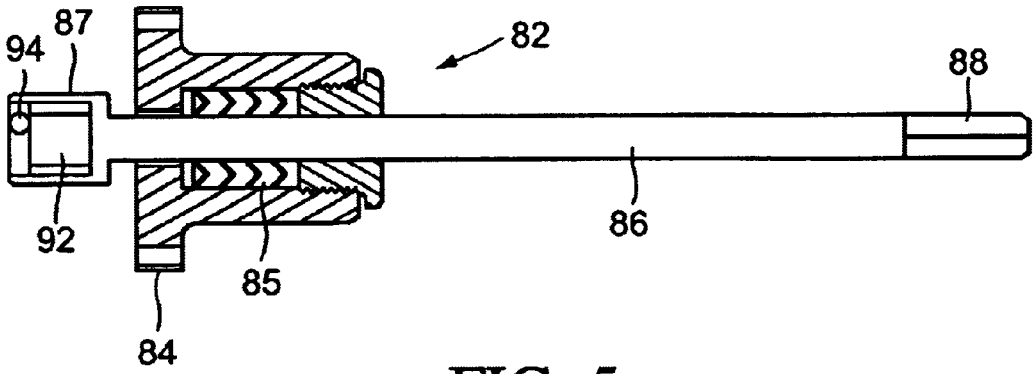
FIG. 5 shows a manipulator or lubricator tool for installation and retrieval of the second valve.

For retrieval of the second valve 26', a lubricator tool 82 as shown in FIG. 5 is used. The tool 82 comprises a mounting flange 84 of the same configuration as the blanking plate 76. A shaft 86 is rotatable in and linearly slidable through a central aperture in the flange 84. The shaft 86 is sealed to the flange 84 by a suitable packing 85 and has a socket 87 at one end and a drive formation 88 for engagement by a wrench or the like at the other. Initially, the first valve 10' is closed. The flange 84 of the tool 82 is bolted and sealed to the adapter 74 in place of the blanking plate 76, with the socket 87 extending into the cavity 80. The valve 10' is then opened, and the shaft 86 stroked through it (if necessary using suitable hydraulic, screw jack or like means to overcome any pressure within the adapter 74). A drive profile 92 inside the socket 87 is thereby engaged over a corresponding non-circular (e.g. hexagonal) profile 90 on a nose portion of the second valve 26'. Spring loaded balls 94 engage in a detent groove 96 to retain the socket 87 on the profile 90. Torque is then applied to the drive formation 88 to unscrew the threaded connection 44 and free the body 40 of the second valve 26' for withdrawal from the passage 41 in the wellhead 14. The second valve 26' can now be withdrawn into the cavity 80 by stroking the shaft 86 back through the first valve 10'. The first valve 10' can then be closed, and the second valve removed from the cavity 80 by unbolting the tool flange 84 from the adapter 74. Installation of a new or refurbished second valve 26' is the reverse of the above procedure, the nose of the second valve first being loaded into the socket 87, and the second valve 26' being fed into the cavity 80 prior to securing and sealing of the tool flange 84 to the adapter 74.

Retrieval and installation of the second valve 26 proceeds in a similar manner, the gas supply pipe 24 being disconnected from the adapter 74 for installation of the tool 82. The second valve 26, 26' also forms an independent pressure barrier that allows the first valve 10, 10' to be readily exchanged or refurbished.

Although the second valve is particularly described as being a fail-closed, resiliently biased, hydraulically actuated check valve especially suitable for use as a pressure bleed valve, other designs for the second valve will be readily apparent, to suit other uses. For example, the second valve may be a flapper type valve, installable/retrievable through a first valve which takes the form of a 3 inch (76.2 mm) gate valve, this arrangement being particularly suitable for gas injection purposes.

It should be recognized that, while the present invention has been described in relation to the preferred embodiments thereof, those skilled in the art may develop a wide variation of structural and operational details without departing from the principles of the invention. For example different features of the various embodiments may be combined in a manner not discussed herein. Therefore, the appended claims are to be construed to cover all equivalents falling within the true scope and spirit of the invention.

What is claimed is:

1. A well valve assembly comprising:

a passage extending through a side wall of a wellhead which separates a well interior from a well exterior; and first and second valves each positioned to selectively open or close the passage;

the second valve in use being located in the passage towards the well interior with respect to the first valve and being installable and retrievable through the passage.

2. A well valve assembly as defined in claim 1, wherein the second valve is installable and retrievable through the first valve.

3. A well valve assembly as defined in claim 1, wherein the second valve is biased towards the closed position.

4. A well valve assembly as defined in claim 3, wherein the closure bias is provided by at least one of a number of Belleville springs and fluid pressure.

5. A well valve assembly as defined in claim 4, wherein the Belleville springs are housed in a chamber isolated from the passage and from the well exterior.

6. A well valve assembly as defined in claim 1, wherein the second valve is remotely actuated.

7. A well valve assembly as defined in claim 6, wherein the second valve is hydraulically actuated.

8. A well valve assembly as defined in claim 1, wherein the second valve comprises a check valve closeable by engagement of a closure member with a valve seat to form a metal to metal seal.

9. A well valve assembly as defined in claim 8, wherein the closure member is slidable in a tubular valve body which is received in the passage.

10. A well valve assembly as defined in claim 9, wherein a hydraulic chamber for actuation of the second valve is defined between the closure member and the body.

11. A well valve assembly as defined in claim 10, wherein the closure member is held in the body by a retainer cartridge, and a further hydraulic chamber is defined between the closure member, the body and the cartridge.

12. A well valve assembly as defined claim 11, wherein the valve seat is formed annularly about the body interior and the closure member further comprises:

an open end defining a hollow interior and a blind end;

a shoulder formed about the blind end for co-operation with the valve seat; and a number of radial ports extending from an exterior surface of the closure member behind the shoulder to the hollow interior of the closure member.

13. A well valve assembly as defined in claim 1, wherein the second valve comprises a flapper valve.

* * * * *